United States Patent [19]

Upchurch

[11] 4,403,659

[45] Sep. 13, 1983

[54] PRESSURE CONTROLLED REVERSING VALVE

[75] Inventor: James M. Upchurch, Stafford, Tex.

[73] Assignee: Schlumberger Technology Corporation, New York, N.Y.

[21] Appl. No.: 253,786

[22] Filed: Apr. 13, 1981

[51] Int. Cl.[3] ..... E21B 34/10

[52] U.S. Cl. ..... 166/374; 166/321; 166/331

[58] Field of Search ..... 166/321, 319, 323, 331, 166/264, 373, 374

[56] References Cited

U.S. PATENT DOCUMENTS

| | | | |
|---|---|---|---|
| Re. 26,638 | 5/1978 | Nutter | 166/128 |
| 2,518,795 | 8/1950 | Knox | 166/331 |
| 3,986,554 | 10/1976 | Nutter | 166/319 |
| 4,113,012 | 9/1978 | Evans et al. | 166/331 |

FOREIGN PATENT DOCUMENTS

| | | | |
|---|---|---|---|
| 600252 | 1/1976 | Fed. Rep. of Germany | 166/321 |

*Primary Examiner*—William F. Pate, III
*Assistant Examiner*—Hoang C. Dang

[57] ABSTRACT

In accordance with an illustrative embodiment of the present invention, a pressure controlled reversing valve for use in drill stem testing includes a housing having reversing ports that normally are closed by a valve sleeve that is mounted on a spring-loaded actuator mandrel, stop means for preventing opening movement of said actuator mandrel, a mechanical counter for disabling said stop means and enabling such opening movement only after a predetermined minimum number of pressure increases have been applied to the fluids standing in the pipe string in which the reversing valve is connected, and means responsive to a subsequent pressure increase for reclosing the valve sleeve and reactivating the stop means.

17 Claims, 10 Drawing Figures

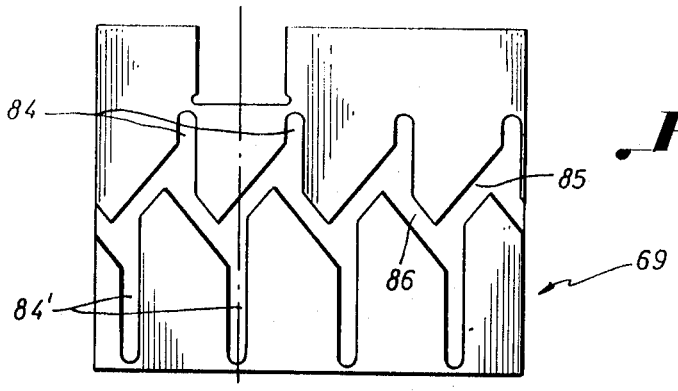
Fig. 4A
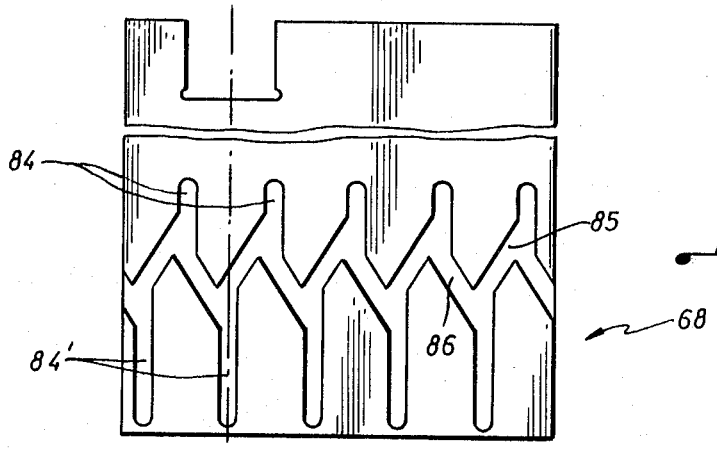
Fig. 4B
Fig. 3
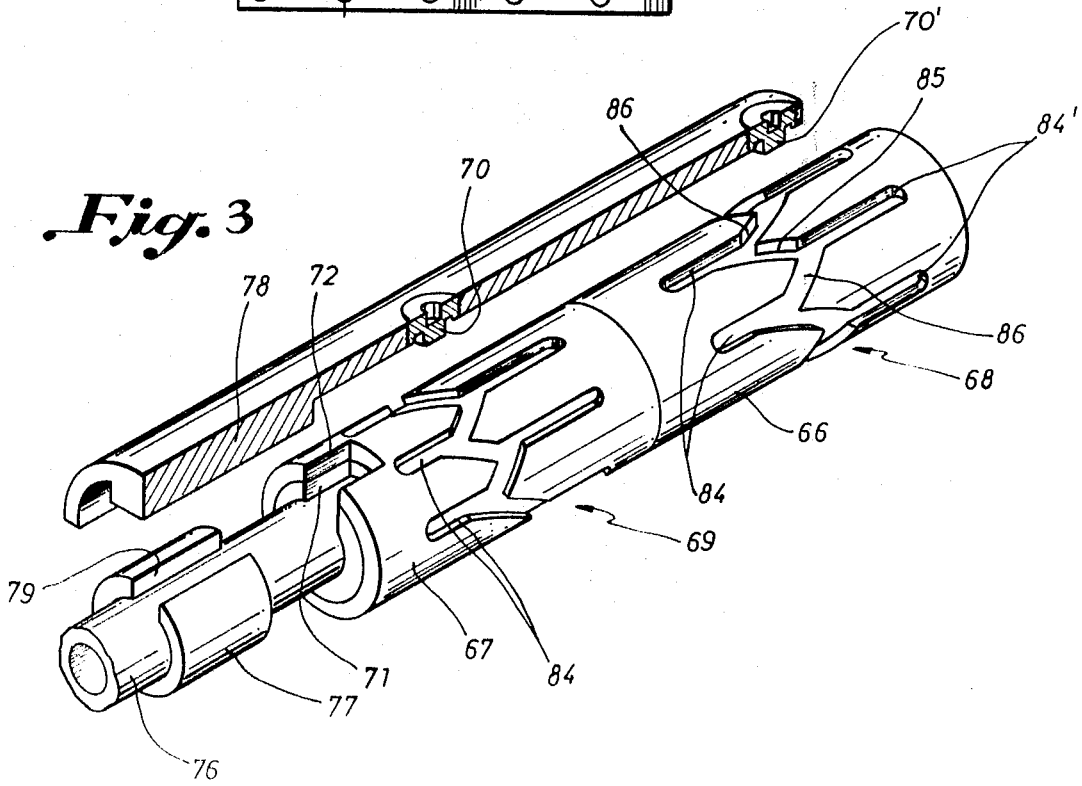

PRESSURE CONTROLLED REVERSING VALVE

FIELD OF THE INVENTION

This invention relates generally to apparatus useful in drill stem testing, and particularly to a new and improved tubing pressure controlled reversing valve that can be opened and then reclosed to enable additional service work to be done in the well.

BACKGROUND OF THE INVENTION

The fluid that is recovered from the formation during the drill stem test of a well accumulates in the pipe string that suspends the test tools. For safety reasons, it is desirable to remove the fluid recovery from the pipe string before withdrawing the tools when the test is completed, or else the fluids may be spilled on the rig floor as pipe joints are disconnected and thereby constitute a considerable fire hazard.

Thus it is common practice to incorporate in a string of drill stem testing tools a component generally known as a reversing valve. A reversing valve is a tool that includes a normally closed valve element which can be opened through suitable mechanical manipulation or pressure changes to provide open communication between the well annulus and the tubing string at a point above the main test valve so that pressure applied to the well annulus can displace the fluid recovery upwardly to the surface where it can be piped to suitable containers or the like.

Most reversing valves are designed such that once they have been opened, they cannot be reclosed. Of course, it will be recognized that with an open communication path between the annulus and the tubing string, it is not generally possible to perform any further testing of the well or any pressure services such as fracturing or acidizing without removing the tools from the well in order to reposition the reversing valve in its normally closed position.

A known reversing valve that can be reclosed without removing it from the well is disclosed in Evans et al., U.S. Pat. No. 4,113,012 issued Sept. 12, 1978. The device disclosed in this patent is annulus pressure responsive, and has a rather complicated system of vertically spaced cam teeth on an index sleeve that coact with lugs on a control mandrel to provide for multiple valve positions and eventual reclosure. However the applicant does not consider an annulus pressure actuated device of the type described to be the better approach for several reasons. For one thing, various other tools in the test string may be annulus pressure operated, so that the Evans et al. valve may be opened at an undesirable time in response to such pressure changes. Moreover, the reference device is structurally quite complicated and accordingly is believed to be rather costly to manufacture and troublesome to maintain.

It is the general object of the present invention to provide a new and improved pressure controlled reversing valve that can be opened and then reclosed while the valve remains in the well.

Another object of the present invention is to provide a new and improved pressure controlled reversing valve that can be opened and then reclosed in response to pressure changes applied to the fluids in the pipe string in which the valve is connected to provide for improved operator control over the sequence of tool component actuation during a well testing operation.

Still another object of the invention is to provide a new and improved pressure controlled reversing valve of the type described that is more economical to manufacture and easier to maintain in operative condition for repeated usage in well testing operations.

SUMMARY OF THE INVENTION

These and other objects are attained in accordance with the concepts of the present invention through the provision of a reversing valve apparatus comprising a tubular housing having one or more reversing ports extending laterally through the wall thereof. A spring-biased valve mandrel is shiftable axially within said housing between a closed position with respect to said ports and an open position with respect thereto, and has a piston section with one side subject to the pressure of fluids in said housing and the other side to the pressure of fluid in the well annulus externally of said housing, so that a predominant fluid pressure in the housing will force the valve mandrel to shift in one axial direction while the bias of the spring urges the mandrel to shift in the opposite axial direction.

A uniquely arranged control system is employed to prevent opening movement of the valve mandrel until a predetermined minimum number of pressure increases has been applied to the interior of the housing. However, when such number is exceeded by one, the next time the pressure is reduced the valve mandrel can shift axially through a distance that is sufficient to cause the reversing ports to be opened. With the valve apparatus in its open condition, a fluid recovery in the pipe can be circulated out the well as previously described by pressure applied at the surface to the well annulus.

The valve mandrel then can be shifted back to its closed position with respect to the reversing ports by again applying pressure to the pipe string on which the tools are suspended. This can be accomplished due to the fact that the valve mandrel is sealed with respect to the housing on multiple diameters; a first larger diameter, a second smaller diameter and a third intermediate diameter. Prior to the opening of the reversing ports, the effective or resultant pressure area of the mandrel is defined by the difference between the areas bounded by the first and second diameters. However, after the reversing ports have been opened, the pressure area of the mandrel is substantially increased and is defined by the difference between the areas bounded by the intermediate diameter and the smaller diameter. This unique arrangement makes it possible to apply pressure to the tubing to cause fluid to be pumped through the reversing ports which afford a restriction to flow and causes a momentary back pressure to exist within the housing which acts on the significantly larger area of the mandrel to shift it quickly back to the closed position where a section thereof blanks off and thus recloses the reversing ports. Responsive to such movement, the control system is reset in its initial condition for further opening and reclosing of the reversing valve apparatus as desired.

BRIEF DESCRIPTION OF THE DRAWINGS

The present invention has other objects and advantages which will become more clearly apparent in connection with the following detailed description of a preferred embodiment, taken in conjunction with the appended drawings in which:

FIG. 3 is an isometric view to illustrate the continuous channel systems that are formed in the sleeves that comprise the pressure responsive control system; and FIGS. 4A and 4B are developed plan views of the channel systems shown in FIG. 3.

DESCRIPTION OF A PREFERRED EMBODIMENT

Figure 1:
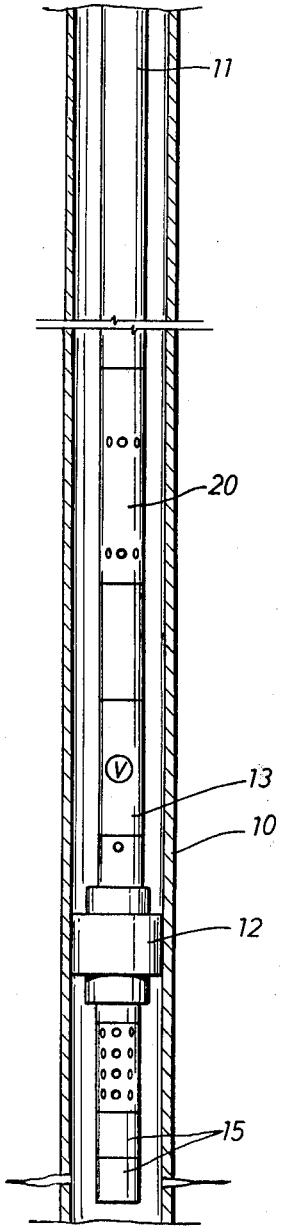
FIG. 1 is a schematic view of a string of drill stem test tools in a well.

Referring initially to FIG. 1, there is shown schematically a string of drill stem testing tools suspended within a well casing 10 on drill pipe 11. The tools comprise a hook wall-type packer 12 that functions to isolate the well interval to be tested from the hydrostatic head of fluids thereabove, and a main test valve assembly 13 that functions to permit or terminate the flow of formation fluids from the isolated interval. The test valve 13 preferably is of a type that may be opened and closed in response to changes in the pressure of fluids in the annulus between the pipe 11 and the casing 10. The valve assembly 13 is well known and is disclosed in U.S. Pat. No. Re. 29,638, assigned to the assignee of the present invention. The disclosure of U.S. Pat. No. Re. 29,638 is incorporated herein by reference. Other equipment components such as a jar and a safety joint may be employed in the string of tools but are not illustrated in the drawings. A perforated tail pipe 14 may be connected to the lower end of the mandrel of the packer 12 to enable fluids in the well bore to enter the tools, and typical pressure recorders 15 are provided for the acquisition of pressure data during the test.

A reversing valve assembly 20 that is constructed in accordance with the principles of the present invention is connected in the pipe string an appropriate distance above the main test valve assembly. As shown in detail in FIGS. 2A–2F, the valve assembly includes a tubular housing 25 that has threads 26 at each end for connecting the same in the tool string and may include several inconnected sections such as an upper sub 27, a control section 28, a cylinder section 29 and a ported section 30. The section 30 has one or more reversing ports 31 extending radially through the wall thereof. A valve mandrel indicated generally at 34 is axially shiftable within the housing 25 and includes an upper section 35, piston sections 36 and 37 and a retainer nut 38 that is used to fix a valve sleeve 40 to the lower end thereof. The valve sleeve 40 carries a seal ring 41 to prevent fluid leakage with respect to the lower end of the piston section 37, and has one or more flow ports 42 extending through the wall thereof that normally are positioned below a seal ring 43 on the housing section 30. The seal ring is arranged to engage the outer wall surface 44 of the valve sleeve 40 to prevent any fluid communication between the reversing ports 31 and 42 in the closed position of the valve apparatus shown in FIG. 2E. An inwardly directed lug 46 on the housing section 30 (FIG. 2F) is slidably engaged in a vertically extending slot 47 formed in the lower portion of the valve sleeve 40 so as to maintain radial alignment of the flow ports 42 with the reversing ports 31 when the valve sleeve is moved upwardly to the open position. The diameter of sealing engagement of the ring 43 is denoted as A in FIG. 2E for purposes of reference hereinafter.

The lower piston section 37 of the valve mandrel 34 has an outwardly directed flange 48 which carries a seal ring 49 that slidably engages an inner annular wall surface 50 of the housing 25 on a diameter denoted as B. The seal diameter B is significantly smaller than the seal diameter A. A pressure communicating port 52 (FIG. 2D) extends through the wall of the housing section 30 above the seal surface 50.

The upper piston section 36 is enlarged in cross-section at its lower end portion and carries a seal ring 53 that slidably engages an inner annular wall surface 54 of the cylinder section 29 of the housing 25. The diameter of sealing engagement of the ring 53 is denoted as C, and this diameter is somewhat larger than the diameter A and is considerably larger than the diameter B. One or more ports 56 extend through the wall of the piston section 36 at a location that is above the upper face 57 of the piston 58 in order to subject this face to the pressure of fluid within the bore 59 of the valve mandrel 34. The downwardly facing surfaces of the piston 58 are subjected to the pressure outside the housing via the ports 52. A coil spring 60 reacts between a downwardly facing shoulder 61 on the piston section 36 and an upwardly facing shoulder 62 on the housing 25. The spring 60 functions to bias the valve mandrel 34 in the upward direction.

Figure 2A:
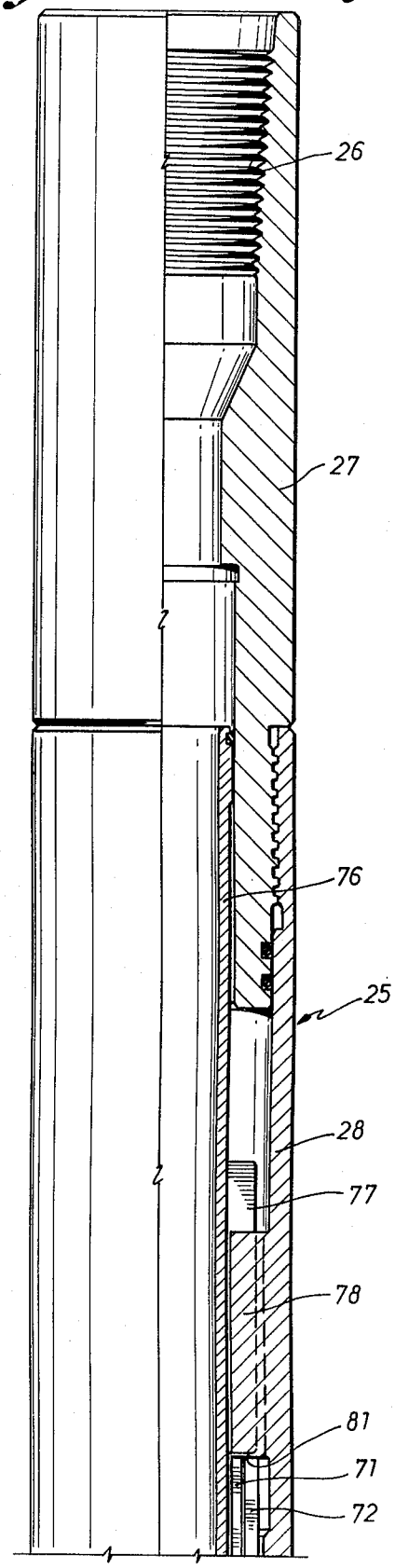
FIGS. 2A–2F are longitudinal sectional views, with portions in side elevation, of a reversing valve assembly in accordance with the present invention.
Figure 2B:
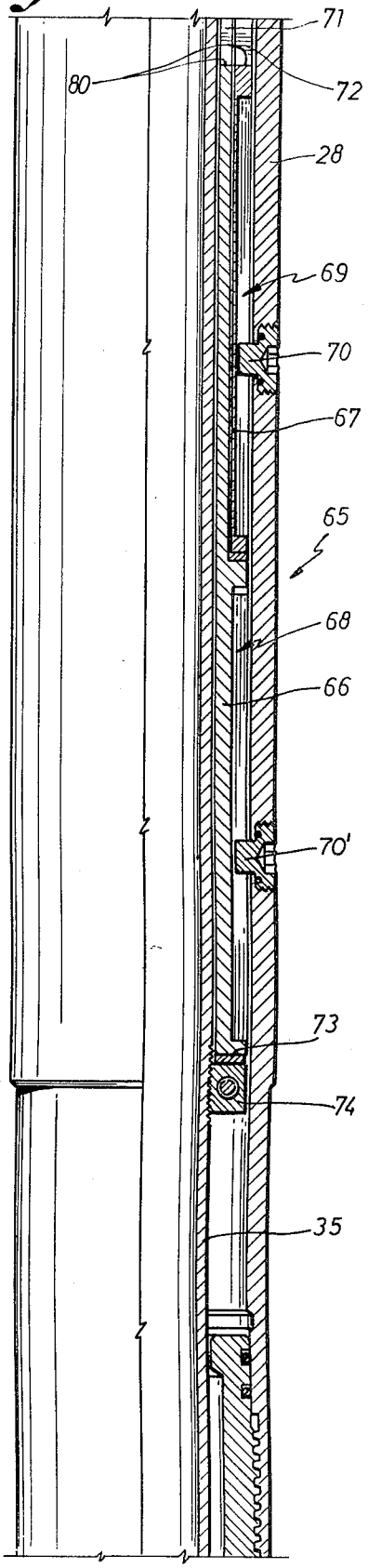
Figure 2C:
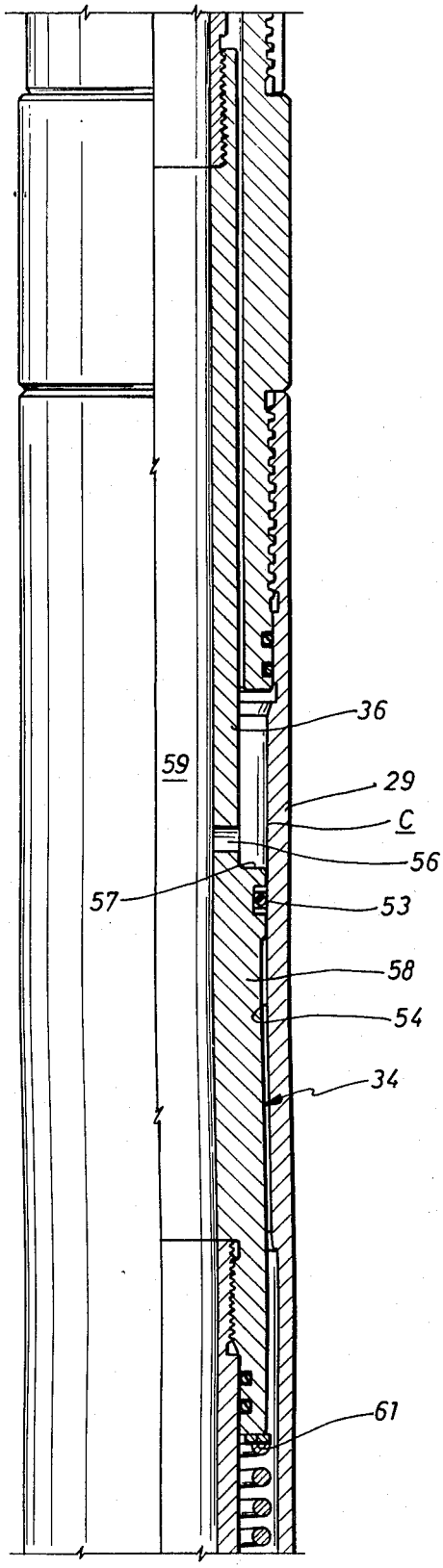
Figure 2D:
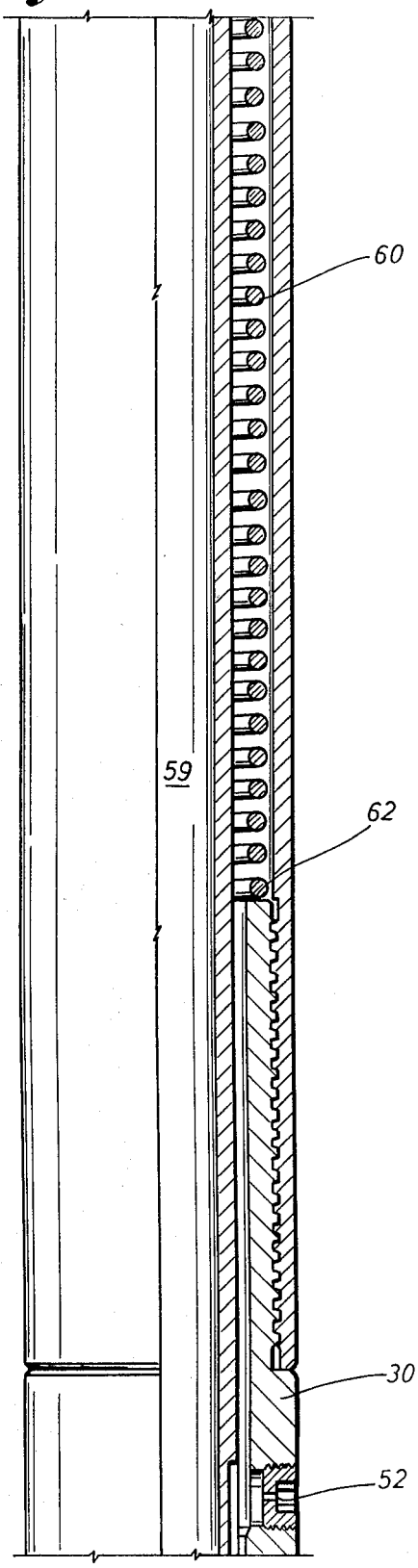
Figure 2E:
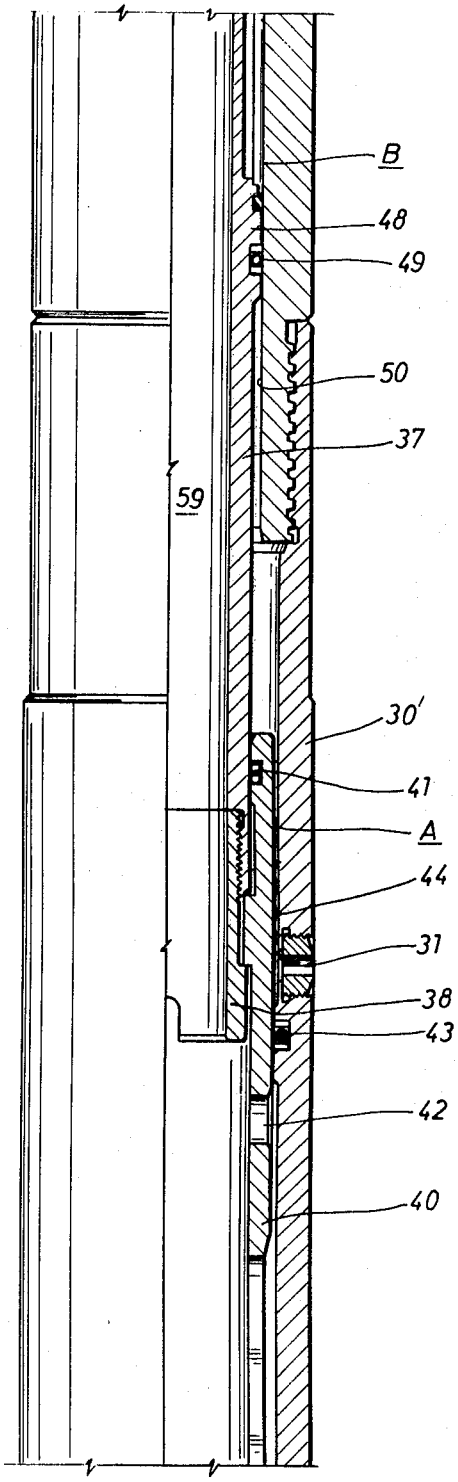
Figure 2F:
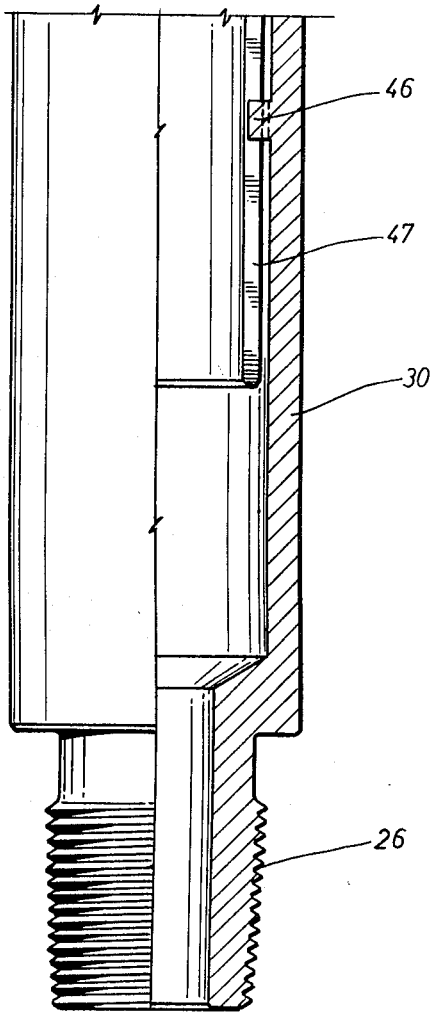

A control system indicated generally at 65 in FIG. 2B is positioned between the upper mandrel section 35 and the upper housing section 28. The system 65 includes relatively rotatable sleeves 66 and 67 each having a continuous J-slot channel arrangement 68, 69 formed in the outer periphery thereof. The channel system 68 in the sleeve 66 is engaged by a lower pin 70' that is fixed to the housing section 28 and extends inwardly thereof, and a similar upper pin 70 engages the channel system 69 of the sleeve 67. Each of the sleeves 66, 67 has an upwardly opening slot 71, 72 formed in the upper end thereof, and it will be recognized that these slots are adapted to be radially aligned with one another in only one relative rotational position of the sleeves 66, 67. A thrust washer 73 that rests on a nut 74 which is threaded to the mandrel 35 provides a bearing to rotatably support the sleeves on the valve mandrel.

The upper end section 76 of the valve mandrel 35 has a drive collar 77 fixed thereto that is arranged to engage the upper end surfaces of the sleeves 66, 67 and to drive the sleeves downwardly with the valve mandrel. An inwardly extending lug 78 on the housing section is sized and arranged to have substantially the same circumferential dimension as the slots 71, 72 in the upper ends of the sleeves 66, 67. The lug 78 limits upward movement of the sleeves 66, 67 and thus the valve mandrel 34 until the slots 71, 72 are radially aligned with each other and with the lug 78, and then and only then will the slots interfit with the lug and thereby allow additional upward movement of the valve mandrel 34 until the bottom surfaces 80 of the slots come into abutting engagement with the lower face 81 of the lug.

The channel systems 68 and 69 formed in the outer periphery of the respective sleeves 66 and 67 are shown in perspective view in FIG. 3 and in developed plan view in FIGS. 4A and 4B. Each of the channel systems comprises a plurality of vertically extending, oppositely disposed slots 84, 84' that are joined by oppositely inclined channels 85, 86. The intersection of each pair of the channels 85, 86 that lead to a slot is offset from the longitudinal axis of that slot as shown so that as the sleeves 66, 67 are reciprocated with the upper section 76 of the valve mandrel 34, the pins 70', 70 cause the sleeves to always rotate in the same rotational direction and to be indexed through an angle equal to the number of slots divided into 360°. Assuming that the stop slots 71, 72 initially are radially aligned as shown in FIG. 3, and then the sleeves 66, 67 are repeatedly reciprocated upward and downward with the mandrel, it can be demonstrated that the stop slots will not again be aligned in the positions shown until the valve mandrel 34 has been reciprocated a number of times that is equal to the product of the number of the slots in each respective sleeve. For example, if the lower sleeve 66 has five slots 84' and the upper sleeve 67 has four slots 84', the stop slots 71, 72 at the upper end of the sleeves will be brought into radial alignment every twentieth time that the sleeves are reciprocated through a down and up cycle.

OPERATION

In operation, the parts of the reversing valve apparatus 20 are assembled as shown in the drawings and the valve is connected in the pipe string 11 above the main test valve 13. Initially, the stop slots 71, 72 in the sleeves 66, 67 are misaligned so that the valve mandrel 34 cannot move upwardly within the housing 25 beyond the position shown in the drawings. Thus as the tools are run into a fluid filled well bore, the hydrostatic head of the fluids acting on the lower face of the piston 58 via the ports 52 cannot shift the mandrel 34 upward since such movement is stopped by engagement of the upper end faces of the sleeves 66, 67 with the housing lug 78. The reversing ports 31 are blanked off by the lower end portion of the valve mandrel 34, with fluid leakage being prevented by the seals 43 and 49. The reversing valve 20 will remain closed with the parts in the relative positions shown in FIGS. 2A–2F so long as the pressure of the fluids filling the bore 59 of the valve mandrel does not exceed the hydrostatic pressure of the fluids in the annulus outside the valve housing 25.

Any and all changes in the pressure of fluids in the annulus that may be employed to operate or control associated equipment in the tool string will not have any operative effect on the reversing valve apparatus 20. When it is desired to open the reversing ports 31 to enable a fluid recovery from the test to be circulated to the surface, pressure is repeatedly applied and then released to and from the fluid standing in the pipe string 11. Each increase in pressure will act via the ports 56 on the upper face 57 of the piston 58 over a transverse cross-sectional area that is the difference in the areas defined by the diameters A and C to cause the valve mandrel 34 to be shifted downwardly against the bias of the coil spring 60. When the applied pressure is released, the coil spring 60 will return the valve mandrel 34 to the upper position where the upper faces of the index sleeves 66, 67 engage the stop lug 78. When the pipe 11 has been pressurized a predetermined number of times equal to the product of the number of slots 84' in the index sleeves, the stop slots 71, 72 in the upper ends of the sleeves will have been rotated into radial positions such that the next subsequent release of pressure in the tubing will cause the slots to interfit with the stop lug 78 and thereby enable the valve mandrel 34 to shift upwardly to a position where the mandrel ports 42 are above the seal 43 and in fluid communication with the reversing ports 31. Then pressure can be applied to the annulus between the pipe string 11 and the casing 12 to cause annulus fluids to enter the bore 59 of the reversing valve and cause circulation of the fluid recovery to the surface where the same can be recovered in a suitable and safe manner.

Should it be desired to reclose the reversing ports 31 so that additional service work, such as acidizing or fracturing, can be performed without removing the tool string from the well, the valve can be reclosed as follows. Fluids are pumped into the tubing 11 at the surface and pass out into the well annulus through the reversing ports 31 which provide a restriction to such flow that causes a back pressure to develop in the bore 59 of the reversing valve. The back pressure acts downwardly on the valve mandrel 34 over a transverse cross-sectional area that is defined by the difference in the diameters B and C of sealing engagement of the piston seal 53 and the intermediate seal 49. The downward force that is generated due to the pressure acting over this substantially larger cross-sectional area forces the valve mandrel 34 downwardly against the bias of the coil spring 60 to a position where the reversing port seal 43 is located above the flow ports 42 in the lower end section 40 of the valve mandrel. When this occurs, flow to the annulus abruptly is stopped so that the valve mandrel 34 moves quickly downward to its lowermost position. Then as the applied pressure in the tubing 11 is released, the valve mandrel 34 is shifted back upwardly by the spring 60. However the index sleeves 66, 67 will have been rotated by the pins 70', 70 to a relative position such that the slots 71 and 72 in the respective upper ends thereof again are misaligned. With this relative position of parts, upward movement of the valve mandrel 34 is stopped in the position shown in the drawings where the reversing ports 31 are closed.

Although the apparatus of the present invention has been disclosed as being useful in the reverse circulation of formation fluids at the end of a drill stem test, it will be recognized by those skilled in the art that it has many other uses. For example, the test tools can be run into the well with the reversing ports 31 open so that the pipe string fills with well fluids, and then a water cushion can be displaced from the surface into the pipe prior to opening the main test valve. At the end of a test, a stimulation fluid such as acid can be spotted by pumping the same into the tubing. Moreover, at the end of a test the mud in the well can be conditioned by circulation to have the proper weight prior to unseating the packer and withdrawing the tools from the well. Although the tool string has been disclosed herein as being disposed in a cased and perforated well bore, it can be used in open hole as well. All such uses and others are possible since the ports 31 can be opened and reclosed as desired, and are intended to be within the scope of the present invention. Of course, the flow rate that is employed to reclose the ports 31 can be changed by varying the number and/or size of the ports that are present in the tool.

It now will be recognized that a new and improved pressure controlled valve that can be opened and reclosed while the valve remains in the well has been disclosed. Since certain changes and modifications may be made in the disclosed embodiment without departing from the inventive concepts involved, is the aim of the appended claims to cover all such changes and modifications falling within the true spirit and scope of the present invention.

What is claimed is:

1. In a well testing apparatus having test tool components adapted to be suspended in a well bore on a pipe string, normally closed reversing valve means including a housing having laterally directed port means adapted to communicate the bore of the pipe string with the well annulus, and means responsive to at least a predetermined minimum number of pressure changes in the pipe string for operating said reversing valve means to enable formation fluids to be removed from the pipe string by reverse circulation of well fluids.

2. The apparatus of claim 1 further including means responsive to at least one additional pressure change for reclosing said reversing valve means.

3. The apparatus of claim 2 wherein said housing has a mandrel slidable in opposite longitudinal directions therein, said port means extending through the wall of said housing, and valve means on said mandrel arranged to close said port means in one longitudinal position of said mandrel within said housing and to open said port means when moved to another longitudinal position within said housing.

4. The apparatus of claim 3 wherein said mandrel has piston means sealingly slidable with respect to said housing, said piston means having one side subject to the pressure of fluids in the well annulus externally of said housing and the other side subject to the pressure of fluids within the bore of said mandrel, said piston means being arranged whereby a predominate pressure of fluids in said bore tends to force said mandrel and valve means toward said one longitudinal position; means for shifting said mandrel toward said other longitudinal position when said predominate pressure is reduced; and control means for limiting movement of said mandrel and valve means toward said other longitudinal position.

5. The apparatus of claim 4 wherein said control means includes stop means normally preventing movement of said mandrel and valve means from said one position to said other position; and counter means for disabling said stop means to enable movement of said mandrel and valve means to said other position.

6. The apparatus of claim 5 wherein said counter means comprises sleeve means rotatably mounted on said mandrel and having channel means engaged by pin means on said housing, said channel means including circumferentially spaced longitudinally extending slots that are connected together by inclined slots in a manner such that as said mandrel slides in opposite longitudinal directions within said housing said pin and channel means cause said sleeve means to rotate with respect to said mandrel in only one rotational direction.

7. The apparatus of claim 6 wherein said stop means includes lug means on said housing engageable with an end surface on said sleeve means, said sleeve means having recess means adapted to receive said lug means and thereby permit movement of said mandrel and valve means to said other position when said sleeve means has been rotated through a predetermined angle.

8. A reverse circulating valve apparatus for use in drill stem testing comprising: a housing adapted to be connected in a pipe string on which test tools are suspended in a well, said housing having reversing port means extending through the wall thereof; a valve mandrel movable longitudinally in said housing, said valve mandrel having valve means for closing said port means in at least one longitudinal position of said valve mandrel and for opening said port means in another longitudinal position thereof; yieldable means for biasing said valve mandrel toward said other longitudinal position; hydraulically operable means responsive to changes in the pressure of fluids in the pipe string for moving said mandrel toward said one position; stop means for preventing movement of said mandrel from said one position to said other position; and means responsive to a predetermined minimum number of pressure changes in said pipe string for disabling said stop means and thereby enabling movement of said valve mandrel to said other position.

9. The apparatus of claim 8 further including means responsive to a further change in pressure in said pipe string for returning said valve mandrel to said one longitudinal position and for reactivating said stop means.

10. The apparatus of claim 8 wherein said hydraulically operable means includes means providing a first resultant transverse surface that is subject to the pressure of fluids in the bore of said mandrel prior to the opening of said port means, and a second resultant transverse surface that is subject to the pressure of fluids in the bore of said mandrel when said port means is open, said second surface being larger in area than said first surface.

11. The apparatus of claim 10 wherein said port means is sized to afford a restriction to flow of fluids from said bore to the well annulus, so that a back-pressure can be developed which acts on said second surface to return said valve mandrel to said one longitudinal position.

12. The apparatus of claim 9 wherein said disabling means comprises sleeve means rotatably mounted on said mandrel, said stop means including lug means on said housing engageable with surface means on said sleeve means, said sleeve means having recess means adapted to receive said lug means in one rotational position of said sleeve means relative to said housing, and means for rotating said sleeve means to said one rotational position.

13. The apparatus of claim 12 wherein said rotating means comprises a circumferentially continuous system of slots formed in the exterior of said sleeve means, said system having vertically extending slots connected by inclined channels, and pin means on said housing engaged in said system of slots.

14. The apparatus of claim 9 wherein said disabling means comprises concentrically arranged sleeves rotatably mounted on said mandrel, said stop means including lug means on said housing engageable with end surface of said sleeves, said sleeves each having a recess that opens through said end surface and is adapted to receive said lug means only when said recesses are aligned with each other and said lug means, and means for rotating each of said sleeves through successive angles that are different from one another until said recesses are so aligned.

15. The apparatus of claim 14 wherein said rotating means comprises a circumferentially continuous system of slots formed in the exterior of each of said sleeves, each system having vertically extending slots connected by inclined channels, and pin means on said housing engaged in each of said systems of slots.

16. A method of controlling communication between the well annulus and the bore of a pipe string having a reversing valve connected therein, said reversing valve including a housing having port means in the wall thereof and normally closed valve means movable between open and closed positions with respect to said port means, comprising the steps of: biasing said valve means toward open position; providing a stop means to prevent the opening of said valve means; and disabling said stop means in response to a predetermined minimum number of pressure changes within said housing to enable said valve means to move to open position.

17. The method of claim 16 comprising the additional steps of: reclosing said valve means in response to an additional change in pressure; and reactivating said stop means.

* * * * *